United States Patent [19]

Shoham

[11] Patent Number: 4,535,510

[45] Date of Patent: Aug. 20, 1985

[54] COTTON DRYING TOWER FOR GINNERIES

[76] Inventor: Ilan Shoham, Kibbutz Einat, Israel

[21] Appl. No.: 539,277

[22] Filed: Oct. 5, 1983

[30] Foreign Application Priority Data

Oct. 15, 1982 [IL] Israel ..... 67002

[51] Int. Cl.[3] ..... D01G 37/00

[52] U.S. Cl. ..... 19/0.27

[58] Field of Search ..... 19/0.27

[56] References Cited

U.S. PATENT DOCUMENTS

| | | | |
|---|---|---|---|
| 2,820,306 | 1/1958 | Smith | 19/0.27 X |
| 2,883,709 | 4/1959 | Deems et al. | 19/0.27 |
| 3,069,730 | 12/1962 | Vandergriff | 19/0.27 X |
| 4,031,593 | 6/1977 | Vandergriff | 19/0.27 |
| 4,143,470 | 3/1979 | Vandergriff | 19/0.27 X |

*Primary Examiner*—Louis K. Rimrodt

*Attorney, Agent, or Firm*—Ostrolenk, Faber, Gerb & Soffen

[57] ABSTRACT

A drying tower for seed cotton in ginneries, which tower comprises four walls and a heated air flow from its bottom to its top. Seed cotton is fed at the top and collected at the bottom of the tower. The cotton is transferred over two sets of horizontal conveyors. The conveyors of one set are arranged in superimposed, spaced relationship along one wall, and the conveyors of the other set along an opposite wall of the tower, so that the centerally portions of the conveyors of one set overlap corresponding portions of the other set. The conveyors of the two sets are driven in opposite directions, thus causing the processed cotton to travel along a tortuous path during which it becomes dried.

7 Claims, 4 Drawing Figures

COTTON DRYING TOWER FOR GINNERIES

The present invention relates to gin drying systems for controlling the cotton fiber moisture content in ginneries.

As known, the moisture control of seed cotton, used at the beginning of cotton processing through the ginnery, is of major importance mainly in the two respects of assuring smooth operation of the processing machinery and for obtaining the best fiber quality. The optimal moisture content is in the range of 5%-6%, whereas that of the cotton supplied from the fields may vary between 4% and 20% or more.

After a few unsuccessful experiments with other types of heated air drying installations, during the early years of the century, the industry had adopted exclusively the so-called "shelf-tower" dryers in which the seed cotton is forced to travel in an airborne manner through a staggered or tortuous path defined by a plurality of superimposed spaced trays in an interlinking or partly overlapping arrangement from the top of the tower to its bottom.

The shelf tower dryers using hot air as conveying means consumes large quantities of heated air (in the order of 5,000 cubic-feet of air per minute at a temperature near the heater of about 300° F. and initial velocity of 5,000 Ft/min.). In terms of fuel consumption, it takes about 4.4 gallons of conventional butane-propane mixture per bale of cotton leaving the ginnery. Only a negligible part of this amount of energy can be recycled or otherwise be made useful in the ginnery for other purposes, while the major part is wasted in the form of hot exhaust air expelled to the atmosphere.

It is therefore the major object of the invention to devise a seed cotton drying system of a more conserving energy consumption.

It is another object of the invention to drive the cotton through the tower by means other than the heated air proper, thereby to increase the time pace during which the cotton is subject to the drying effect of said heated air.

It is a still further object of the invention to feed the cotton, and to drive the heated air in generally opposite directions, in order to increase the efficiency of the drying process by having the more hot and more dry air first encounter the less moistened cotton, and vice-versa.

It is still a further object of the invention to transfer the cotton by mechanical means, thus allowing a wide range of control over the travel velocity of the cotton as a function of the other parameters governing the efficiency of the drying process, such as the humidity of the incoming cotton and the ambient temperture prevailing in the drying tower.

It is still a further object of the invention to facilitate the control of the drying phase to conform the condition and processing requirements of the remaining portions of the ginning processing system.

According to a general aspect of the invention there is provided a gin drying system for controlling the moisture content of seed cotton, comprising a four-sided drying tower, heated air supplying means provided at a lower section of the tower, air exhaust means provided at a higher section of the tower, seed cotton feeding means provided at a higher section of the tower, seed cotton transferring means provided between said higher and said lower sections of the tower, said transferring means comprising two sets of horizontally extending cotton conveying means having a length of less than the distance between two opposite sides of the tower, one of the sets being arranged in superimposed, spaced relationship along one of said sides and the other set being arranged in superimposed, spaced relationship along the other of said sides so that at-least a centrally located portion of one of the sets is spaced from and overlaps the corresponding centrally located portions of the other set, and means for driving the conveying means in opposite directions so that seed cotton fed to the tower will be conveyed by the conveying means of the two sets while dropping by gravity from one conveying means of one set to a lower conveying means of the other set.

The conveying means may comprise a plurality of rotatable parallel shafts carrying thereon series of discs mounted on one shaft project into spaces formed between discs mounted on an adjacent shaft.

All the conveyor means of both sets may be coupled to each other for a common, unidirectional rotation thereof by a motor and a single driving belt.

These and further constructional features and advantages of the invention will become clearly understood in the light of the ensuing description, of a preferred embodiment of the invention, given by way of example only with reference to the accompanying drawings, wherein—

Figure 1:
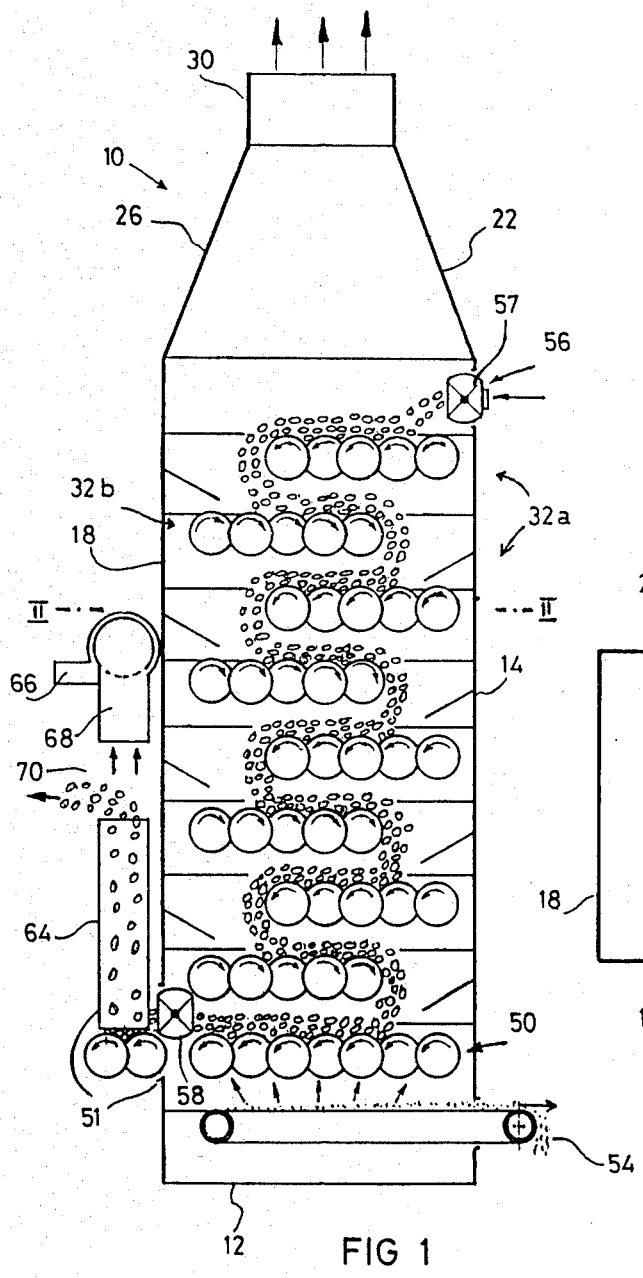
FIG. 1 is a schematic longitudinal cross-section to the tower according to the invention.

As seen in the drawings, drying tower 10 is a prismatic structure having a base 12 of a square or rectagular shape, four side-walls 14, 16, 18 and 20, four inwardly sloping wall sections 22, 24, 26 and 28 and an exhaust section 30.

Within the tower structure there are installed two sets of horizontally extending multirollers conveyors generally indicated **32*a* and 32*b*, respectively. The conveyors 32*a* are mounted along the tower wall 14 in a vertically spaced relationship and extend in the direction of the opposite tower wall 18 by a length less than the width of the tower (i.e. the walls 16 and 20). The same applies to the other set of conveyors 32*b* which are closer to the wall 18**. Thus, the central portions of both conveyors sets are located one between the other in a staggered, vertically overlapping relationship.

Figure 2:
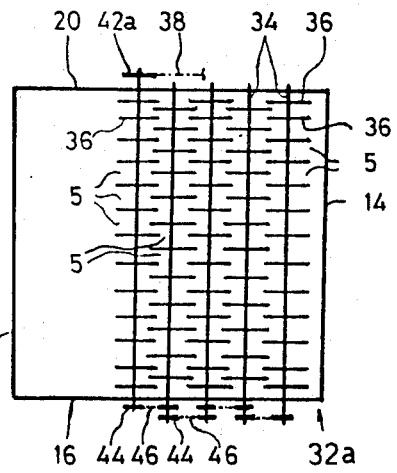
FIG. 2 is a view taken along lines II—II of FIG. 1.

As more clearly seen in FIG. 2, (of one of the rollers conveyors **32*a*), each of the conveyors is comprised of a number (5) of parallel shafts 34, each carrying a series of discs 36. The distance between adjacent shafts 34, and the diameter of the discs 36 are such that the discs of one shaft project into spaces S (shown exaggerated in FIG. 2) which are maintained for this purpose between the discs of the adjacent shaft. Through this interlocking arrangement of the discs, a common, continuous conveying surface for seed cotton is achieved, constituted by the uppermost peripheral sectors of all the discs—see FIG. 1**.

The rims of the discs are preferably roughened or knurled to increase the friction conveying forces between the discs and the cotton seeds.

Figure 3:
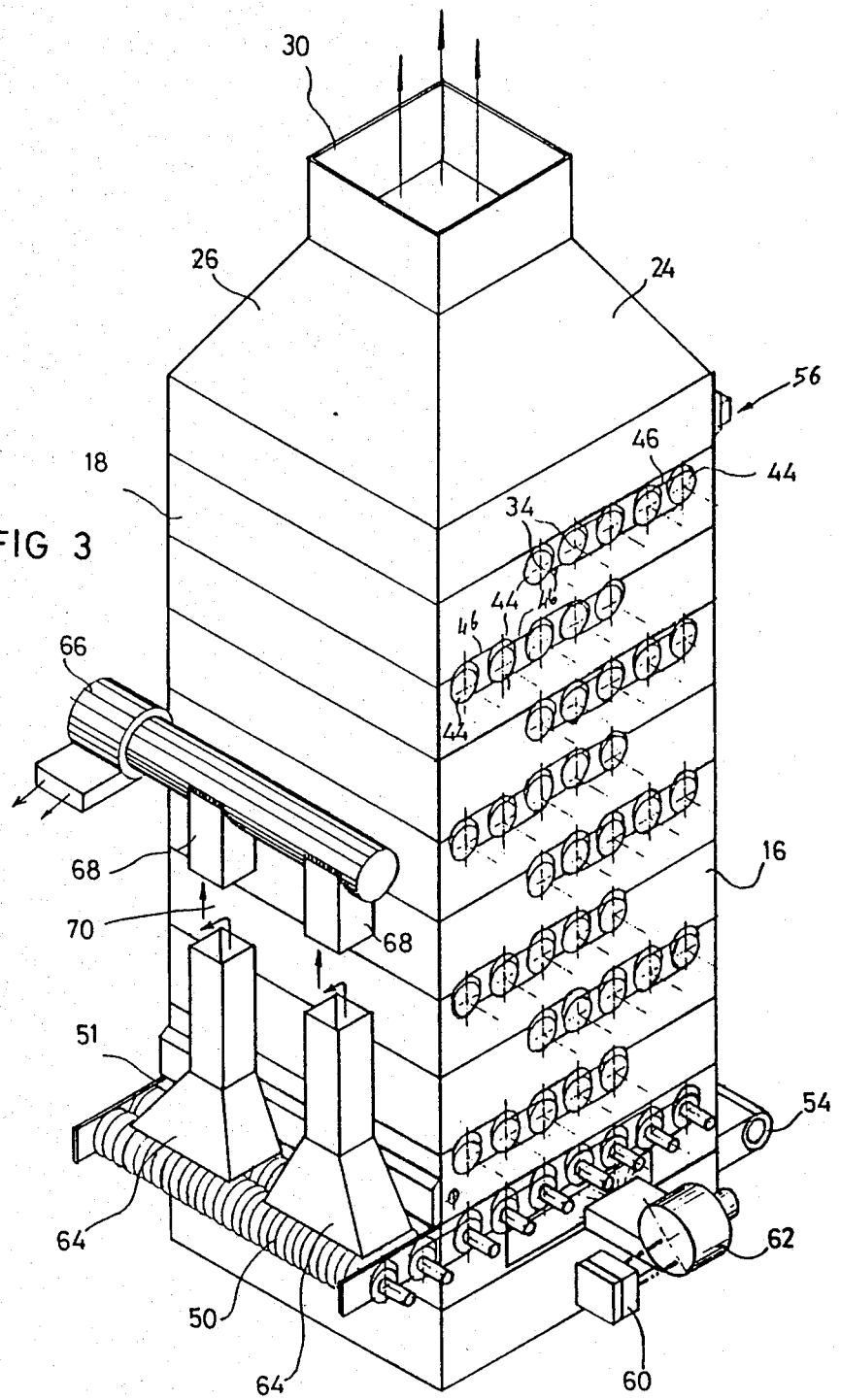
FIG. 3 is a three-dimensional view of one side of the tower of FIG. 1, illustrating the transmission of the rollers-sets of the cotton conveying means.

The combined rotation of all the rollers sets is effected in the following manner. A main driving belt (or chain) 38 (FIG. 4) driven by a motor 40 is slung over main pulleys 42*a* and 42*b* keyed to the shafts 36 of each set which are most centrally located. The rotation of these shafts is transmitted to the remaining shafts by pairs of intermediate pulleys 44 and belts 46—see FIGS. 2 and 3. Through this arrangement it is achieved that all the rollers of the right-hand side set 32*a* will rotate in one, counter-clockwise direction, whereas the rollers of the other set 32*b* will rotate in the opposite, clockwise direction.

Figure 4:
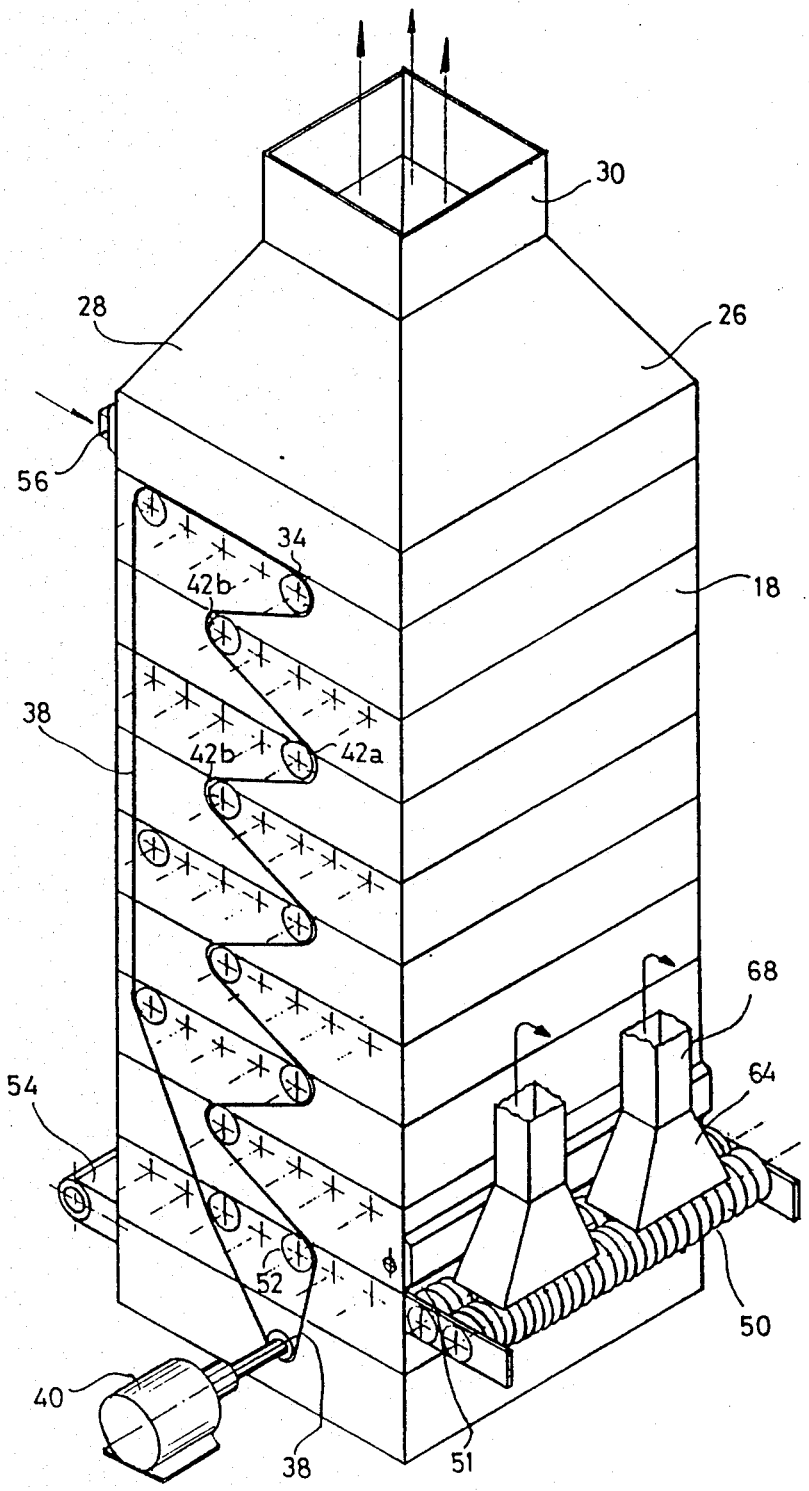
FIG. 4 is a three-dimensional view of the other side of the tower of FIG. 1, illustrating the main transmission system of the conveying means.

An additional roller conveyor device 50 is horizontally disposed at the lower part of the tower, which conveys the dried cotton through a suitable opening 51 at the wall 18, outside the tower. It is of basically the same structure as conveyors 32 and also driven by the main transmission belt 38 coupled to a main pulley 52 (FIG. 4).

At the lowermost section of the tower 10, a belt-type conveyor 54 is installed, partly projecting through the wall 14 thereof.

A cotton charging device, generally indicated 56, is provided at the upper part of the wall 14 (FIG. 1) comprising revolving vanes 57 (known in the art as "vacuum wheel" or "dropper"). Such devices are used to supply or discharge objects into or out of spaces maintined under sub-or-over-atmospheric pressure conditions.

A similar device 58 is provided at the lower section of the wall 18, in the conveying path of the conveyor 50.

Heated air supply installation in the form of a fuel burner 60 and a blower 62 (FIG. 3) is provided at the bottom of the wall 16, which hot air is adapted to escape the tower through the top opening section 30.

Cotton vacuum or suction-operated collecting funnels 64 are positioned above the projecting portion of the conveyor 50 operated by vacuum generated by a blower 66 whose function is to suck the air through ducts 68 inducing suction from the funnels 64 across an air gap 70—as known in the art.

The operation of the drying tower will now be described. Seed cotton is supplied to the tower through the feeding device 56. The cotton now follows a tortuous or staggered, generally downwardly directed path, defined by the alternate oppositely driven conveyors 32*a* and 32*b*. During its travel the cotton will become dried by hot air flowing upwardly from the blower 62 to the exhaust top opening 30.

The processed cotton will eventually fall on the collecting conveyor 50 and become discharged from the tower through the vacuum wheel 58 and the remaining section of the conveyor 50 where it becomes picked-up by the section funnels 64. Trash and other foreign bodies separated from the cotton during its travel over the discs 36 and therebetween will be discharged by the belt conveyor 54 and disposed of.

This counter-flow of the cotton and the hot air assures, as aforesaid, the encountering of the more hot air with the more dry cotton, and vice-versa, which feature improves the drying effect and the utilization of the invested heating energy; secondly, the progress of the cotton depends no longer on the air stream velocity, as in the airborne based systems, thus avoiding the large energy loses which were inherent to the known systems.

Since the cotton is now driven by mechanical means, i.e. through the rotation of the discs 36, easy, convenient, and flexible control over a period of time during which the cotton will be subjected to the drying effect is attained, with the necessary adjustment to the actual conditions of the processed cotton. This may even avoid the necessity of processing the cotton through a second stage of drying by an additional, costly drying tower installation as commonly found in conventional ginneries.

While the invention has been described with respect to rollers-type conveying means, it will be readily appreciated that other types of conveyors, such as woven-wire or net conveyors may equally be employed. Other variation and modifications of the invention will be appreciated.

What is claimed is:

1. A gin drying system for controlling the moisture content of seed cotton, comprising— a four-sided drying tower;

heated air supplying means provided at a lower section of the tower;

air exhaust means provided at a higher section of the tower;

seed cotton feeding means provided at a higher section of the tower;

seed cotton transferring means provided between said higher and said lower sections of the tower, said transferring means comprising two sets of horizontally extending cotton conveying means having a length less than the distance between two opposite sides of the tower, one of the sets being arranged in superimposed, spaced relationship along one of said sides and the other set being arranged in superimposed, spaced relationship along the other of said sides so that at least a centrally located portion of one of the sets is spaced from and overlaps the corresponding centrally located portions of the other set, and means for driving the conveying means in opposite directions so that seed cotton fed to the tower will be conveyed by the conveying means of the two sets while dropping by gravity from one conveying means of one set to a lower conveying means of the other set.

2. The system as claimed in claim 1, wherein said conveying means comprise a plurality of rotatable parallel shafts carrying thereon series of discs so that discs mounted on one shaft project into spaces formed between discs mounted on an adjacent shaft.

3. The system as claimed in claim 2, wherein the rim of the discs are roughened.

4. The system as claimed in claim 3, wherein the shafts of the conveyors are coupled to each other for a common, unidirectional rotation thereof.

5. The system as claimed in claim 4, wherein all the conveyor means of both sets are coupled to each other and to a driving motor by pulleys and a single driving belt.

6. The system as claimed in claim 1, wherein cotton is adapted to be fed into the tower at said higher section thereof through a rotatable vane vacuum wheel device.

7. The system as claimed in claim 6 wherein cotton is discharged from the tower through a rotatable vane vacuum wheel device.

* * * * *